US012138560B2

(12) United States Patent
Ørnstrup et al.

(10) Patent No.: US 12,138,560 B2
(45) Date of Patent: Nov. 12, 2024

(54) TOY CONSTRUCTION SYSTEM FOR CONSTRUCTING AND OPERATING A REMOTE CONTROLLED TOY VEHICLE MODEL

(71) Applicant: LEGO A/S, Billund (DK)

(72) Inventors: Jonathan Nikolas Ørnstrup, Billund (DK); Andrew Butler Coghill, Billund (DK); Jesper Bruun, Billund (DK); Grischa Simon Guzinski, Billund (DK); Elodie Marie Sarah Flora Lepaludier, Billund (DK); Anders Torndahl, Billund (DK); Henning Mikkelsen, Billund (DK); Henrik Havelund Larsen, Billund (DK); Mikkel Mølbjerg Lund, Billund (DK); Martin Bo Laursen, Billund (DK); Jakob Bech Christensen, Billund (DK); Louis Elwood-Leach, Billund (DK)

(73) Assignee: LEGO A/S, Billund (DK)

( * ) Notice: Subject to any disclaimer, the term of this patent is extended or adjusted under 35 U.S.C. 154(b) by 198 days.

(21) Appl. No.: 17/638,490

(22) PCT Filed: Aug. 26, 2020

(86) PCT No.: PCT/EP2020/073796
§ 371 (c)(1),
(2) Date: Feb. 25, 2022

(87) PCT Pub. No.: WO2021/037880
PCT Pub. Date: Mar. 4, 2021

(65) Prior Publication Data

US 2022/0379230 A1 Dec. 1, 2022

(30) Foreign Application Priority Data

Aug. 28, 2019 (DK) ..... 201970538

(51) Int. Cl.
*A63H 33/04* (2006.01)
*A63H 30/04* (2006.01)

(52) U.S. Cl.
CPC ..... *A63H 33/042* (2013.01); *A63H 30/04* (2013.01); *A63H 2200/00* (2013.01)

(58) Field of Classification Search
None
See application file for complete search history.

(56) References Cited

U.S. PATENT DOCUMENTS 3,005,282 A 10/1961 Kirk
6,443,796 B1 9/2002 Shackelford
(Continued)

FOREIGN PATENT DOCUMENTS

CN 103764236 A 4/2014
CN 103930182 B 2/2017
(Continued)

OTHER PUBLICATIONS

International Search Report issued in corresponding International patent application No. PCT/EP2020/073796, mailed Nov. 13, 2020, 4 pages.
(Continued)

*Primary Examiner* — Damon J Pierce
(74) *Attorney, Agent, or Firm* — Day Pitney LLP; George Chaclas; Anthony A. Kassas

(57) ABSTRACT

The present invention relates in one aspect to a toy construction system for constructing and operating a remote controlled toy vehicle model. The system comprises: a plurality of modular toy elements; a modular toy vehicle base detachably connectable with the modular toy elements by means of coupling members so as to construct a toy vehicle model; and a remote control device adapted to control motorized functions in the modular toy vehicle base.
(Continued)

The modular toy vehicle base further comprises an interaction sensor adapted to generate an interaction signal in response to a mechanical interaction with the toy vehicle model; wherein the toy construction system further comprises a processor with a signal analysis process. The signal analysis process is configured to perform an analysis of the interaction signal for indications of a building interaction according to predetermined criteria, and based on the analysis to generate an output indicative of a building interaction status.

22 Claims, 4 Drawing Sheets

(56) References Cited

U.S. PATENT DOCUMENTS

| | | | |
|---|---|---|---|
| 7,243,053 | B1 | 7/2007 | Small |
| 7,275,975 | B2 | 10/2007 | Trageser et al. |
| 7,758,399 | B2 | 7/2010 | Weiss et al. |
| 7,905,761 | B2 | 3/2011 | Weiss et al. |
| 8,216,036 | B2 | 7/2012 | Eyzaguirre et al. |
| 8,545,284 | B2 | 10/2013 | Baarman et al. |
| 8,845,384 | B2 | 9/2014 | Ghaly |
| 8,845,385 | B2 | 9/2014 | Sofman et al. |
| 8,894,461 | B2 | 11/2014 | Horovitz |
| 9,446,325 | B2 | 9/2016 | Kudo et al. |
| 10,363,491 | B2 | 7/2019 | Ferreyra et al. |
| 2007/0293124 | A1 | 12/2007 | Smith et al. |
| 2010/0203933 | A1 | 8/2010 | Eyzaguirre et al. |
| 2013/0217294 | A1 | 8/2013 | Karunaratne |
| 2013/0217295 | A1 | 8/2013 | Karunaratne |
| 2014/0178847 | A1 | 6/2014 | Akavia et al. |
| 2016/0129358 | A1 | 5/2016 | Eversoll et al. |
| 2017/0173485 | A1 | 6/2017 | Liotta et al. |
| 2017/0182407 | A1 | 6/2017 | Steele et al. |
| 2020/0298134 | A1 | 9/2020 | Hu |

FOREIGN PATENT DOCUMENTS

| | | | |
|---|---|---|---|
| CN | 112449611 | A | 3/2021 |
| CN | 115245684 | A | 10/2022 |
| EP | 2364756 | A1 | 9/2011 |
| EP | 2364756 | B1 | 8/2014 |
| JP | 2022106252 | A2 | 7/2022 |
| WO | 2001/97937 | A1 | 12/2001 |
| WO | 0197937 | | 12/2001 |
| WO | 2003/066178 | A2 | 8/2003 |
| WO | 03066178 | | 8/2003 |
| WO | 2005/042126 | A1 | 5/2005 |
| WO | 2006/041757 | A1 | 4/2006 |
| WO | 2008/145980 | A9 | 12/2008 |
| WO | 2008145980 | A1 | 12/2008 |
| WO | 2013/122798 | A1 | 8/2013 |
| WO | 2015/173246 | A1 | 11/2015 |
| WO | 2017143960 | A1 | 8/2017 |
| WO | 2020007668 | A1 | 1/2020 |

OTHER PUBLICATIONS

Written Opinion issued in corresponding International patent application No. PCT/EP2020/073796, mailed Nov. 13, 2020, 8 pages.

Search Report issued in corresponding Danish patent application No. PA201970538, dated Feb. 18, 2020, 4 pages.

Office Action for Chinese Patent Application 202080060353.4, dated Feb. 4, 2023, 7 pages (no translation).

TOY CONSTRUCTION SYSTEM FOR CONSTRUCTING AND OPERATING A REMOTE CONTROLLED TOY VEHICLE MODEL

The present application claims priority to PA201970538 dated Aug. 28, 2019, and is a U.S. national stage application under 35 U.S.C. 371 of co-pending International Application No. PCT/EP2020/073796 filed on Aug. 20, 2020, the contents of each are incorporated by reference herein in their entirety for all purposes.

The present invention relates in one aspect to a toy construction system for constructing and operating a remote controlled toy vehicle model, the system comprising: a plurality of modular toy elements, a modular toy vehicle base detachably connectable with the modular toy elements by means of coupling members so as to construct a toy vehicle model, and a remote control device adapted to control motorized functions in the modular toy vehicle base.

BACKGROUND OF THE INVENTION

Remote controlled toy vehicles are popular fun toys that allow controlling a toy vehicle model that has been enhanced with motorized functions, thus appealing to the playful spirit of children of all ages. An important source for the fun appeal in such toys resides in the role playing experience associated with operating a remote controlled vehicle. One may assume the role of e.g. a race driver, a helicopter pilot, a ship's captain, a farmer, or an operator of construction machinery, thus entering in play a world of racing, flying, boating, farming or construction.

To further enhance the play experience remote controlled toy construction kits have been devised that facilitate creative construction of customized vehicles, which may then be operated as remote controlled toy vehicles in a known manner. Such kits may include modular toy elements, as well as compatible motor and control elements that are adapted to be detachably connected with the modular toy elements and with each other so as to construct all kinds of remote controlled vehicles only limited by the imagination of the user. However, the building play experience for such kits is limited to the construction phase, while the subsequent play experience of operating the remote control vehicle essentially remains unchanged.

More advanced robotic toy construction kits are also known, which allow for the construction of sophisticated robotic models that have motorized functions that can be remote controlled from an associated control program implemented in e.g. a smart device. The core of such robotic toy construction kits is typically a microcontroller, which may be programmed freely to perform different motorized functions and/or provide functional output through all kinds of actuators for providing motion, sound, and light. The robotic models may be further enhanced by sensors that may be coupled to the microcontroller to allow the robotic model to sense environmental parameters, and the microcontroller may then be programmed to control the robotic model in response to these environmental parameters. However, such robotic toy construction kits are typically directed to stimulate and teach rather advanced engineering skills. The play experience with such robotic toy construction kits therefore heavily relies on the mechanical, electronic, and programing skills of the user. This tends to mask the "go-to" fun appeal in the role playing experience of operating a remote controlled vehicle, simply because the robotic toy construction kits usually are directed to a different kind of play experience.

Another approach, which is directed to enhance the play experience when controlling an operational scale model, is disclosed in U.S. Pat. No. 7,243,053 B1. In this approach, a virtual scale model operating environment is created, where functions of the operational scale model are controlled in response to user inputs to a radio controller. A virtual controller is adapted to modify the user inputs responsive to virtually simulated environmental parameters to provide modified control for the toy vehicle. While virtually enhancing the play experience of operating the toy vehicle, the drawback of this approach is that it creates a virtual layer between the user and the toy vehicle at the expense of the physical play experience of physically interacting with the toy vehicle.

WO 2001/97937 A1 discloses a modular toy construction system with a base plate having electrical connectors, so-called hot spots, which allow a controller of the system to identify different special pieces when these are connected to the hot spot.

US 2016/0129358 A1 discloses a vehicle toy that can work with common construction blocks for integration into construction projects. The vehicle toy may be controlled from an assigned controller. In one example, the vehicle toy may have a bumper connected with a switch to indicate mechanical contact between the bumper and some external structure.

Therefore there is still a need for new measures for enhancing the play experience of remote controlled vehicles, or at least a need for alternative approaches to enhancing the play experience of remote controlled vehicles.

SUMMARY OF THE INVENTION

In one aspect, the object of the invention is achieved by a toy construction system according to claim 1 with advantageous embodiments as defined in the dependent claims and as further described herein.

According to a broad aspect, a toy construction system for constructing and operating a remote controlled toy vehicle model comprises: a plurality of modular toy elements; a modular toy vehicle base detachably connectable with the modular toy elements by means of coupling members so as to construct a toy vehicle model; and a remote control device adapted to control motorized functions in the modular toy vehicle base; wherein the modular toy vehicle base further comprises an interaction sensor adapted to generate an interaction signal in response to a mechanical interaction with the toy vehicle model. This embodiment allows for constructing a toy vehicle model and subsequently, when operating the constructed toy vehicle model, detecting a physical interaction by means of the interaction sensor. The interaction signal may be directly made available to an output actuator so as to produce e.g. motion, sound, or light effects in response to a detected mechanical interaction, and/or may be provided as an input to a computer game associated with the remote controlled vehicle so as to e.g. trigger a game event in the computer game, and/or modify e.g. the course of the computer game, in response to a detected mechanical interaction.

Advantageously, the toy construction system may further comprise a processor with an implementation of a signal analysis process, the signal analysis process being configured to perform an analysis of the interaction signal for indications of a specific kind of interaction according to pre-determined criteria. Based on the analysis, the signal analysis process may generate an output indicative of a status for said specific kind of interaction. For example, the output may comprise parameters indicating the occurrence (or not) of the specific kind of interaction, and/or further details and characteristics about the specific interaction that may e.g. be related to the spatial and/or temporal properties of the observed interaction signal. Preferably, the specific kind of interaction is a building interaction. The toy construction system can thus detect that a building interaction with the toy vehicle model has occurred, or even identify the type of building interaction.

According to a particular aspect, the invention relates to a toy construction system for constructing and operating a remote controlled toy vehicle model, the system comprising: a plurality of modular toy elements; a modular toy vehicle base detachably connectable with the modular toy elements by means of coupling members so as to construct a toy vehicle model; and a remote control device adapted to control motorized functions in the modular toy vehicle base; wherein the modular toy vehicle base comprises an interaction sensor adapted to generate an interaction signal in response to a mechanical interaction with the toy vehicle model; wherein the toy construction system further comprises a processor with a signal analysis process, the signal analysis process being configured to perform an analysis of the interaction signal for indications of a building interaction according to pre-determined criteria, and based on the analysis to generate an output indicative of a building interaction status.

Advantageously, a toy construction system for constructing and operating a remote controlled toy vehicle model comprises: a plurality of modular toy elements, each modular toy element comprising coupling members for detachably connecting the modular toy elements with each other; a modular toy vehicle base comprising: a vehicle base housing with coupling members for detachably connecting the modular toy vehicle base with further modular toy elements of the toy construction system to construct a toy vehicle model; and, most preferably arranged within the vehicle base housing, one or more motors, a vehicle base controller coupled to the one or more motors, and a communication device coupled to the vehicle base controller; wherein the modular toy vehicle base further comprises an interaction sensor adapted to generate an interaction signal in response to a mechanical interaction with the toy vehicle model; and wherein the toy construction system further comprises a signal analysis process configured to perform an analysis of the interaction signal for indications of a building interaction according to pre-determined criteria, and based on the analysis to generate an output indicative of a building interaction status. Advantageously, the toy construction system further comprises a remote control device, the remote control device comprising: a user control interface for receiving user input; a processor comprising a computer game process defining a virtual game environment associated with the toy vehicle model, and a control instructions process for generating control instructions for the operation of the toy vehicle model based on the definition of the virtual game environment and on user input received from the user control interface; and a communication interface coupled to the processor, wherein the communication interface is adapted to communicate with the communication device of the modular toy vehicle base.

Generally, a building interaction as used herein is understood as an interaction for adding, or removing, one or more modular toy elements. A building interaction with a toy vehicle model involving at least the modular toy vehicle base and a modular toy element of the toy construction system thus refers to the addition to, or where applicable removal from, the toy vehicle model of a modular toy element, or of a composite part comprising a group of modular toy elements. A building interaction as used herein is thus understood as adding, or removing, a modular toy element, or a group of modular toy elements, to/from another modular toy element, or another group of modular toy elements, or the modular toy vehicle base itself. A building interaction with a toy vehicle model may thus be detected by monitoring the interaction signal generated by the interaction sensor in the modular toy vehicle base, and analysing the interaction signal to determine an addition or removal of one or more modular toy elements or group of modular toy elements. As further detailed below, such addition, or removal, is detectable by performing the analysis of the observed interaction signal according to pre-determined criteria. Criteria for the interaction signal may be formulated e.g. in respect of its size, direction, time-dependence, and/or any pattern in an observation of multiple distinct values of the interaction signal. The criteria may include simple thresholding, ranging in respect of upper and/or lower limits, a comparison of multiple distinct values to each other and/or to reference values (normally within typical limits of error margins), or similar. In some embodiments, when analysing an interaction signal comprising a plurality of distinct values that may be seen as an interaction signal pattern, the criteria may also be formulated using pattern recognition techniques in order to determine whether or not an observed interaction signal pattern exhibits characteristic traits of a building interaction.

The analysis is for developing from the observed interaction signal a status of the toy vehicle model with respect to the occurrence of a building interaction, according to the pre-determined criteria to which the signal analysis process is configured. Typically, the criteria reflect characteristics in the interaction signal as produced by such building interaction. The characteristics of such building interaction signals may be determined beforehand and the criteria may then be formulated accordingly. Applying the pre-determined criteria to the observed interaction signal provides indications of a building interaction. Based on the result of the analysis, an output indicative of a building interaction status may be generated. For example, the output from the signal analysis process may indicate whether or not a building interaction has occurred, and/or details on a building interaction that has occurred as derivable from the information on mechanical interaction with the toy vehicle model as carried by the observed interaction sensor signal.

The plurality of modular toy elements may include passive modular toy elements without any electrical or optical functionality beyond any mechanical functionality and the capability to form detachable connections with other modular toy elements of the toy construction system. Examples for such passive modular toy elements are conventional bricks with coupling members of the stud and cavity type, detachable wheels, propellers, simple hinges or the like. Any motors are for providing propulsion power and/or servo power e.g. for steering control or for performing other powered functions. For example, one or more motors comprised in the modular toy vehicle base may include a propulsion motor for providing propulsion power and/or a servo motor for providing servo power to a mechanical function. Furthermore, optional actuators may be attached to the toy vehicle model for providing user-perceivable output, in particular operation specific user-perceivable output, such as motion, vibration, sound, light, and/or even video. The actuators for providing user-perceivable output may be controlled from the modular toy vehicle base, e.g. via a vehicle base controller arranged in the modular toy vehicle base. Advantageously, such actuators for providing user-perceivable output may also be provided as functional modular toy elements comprising coupling members for releasably coupling the functional modular toy elements with other modular toy elements of the toy construction system, and may be powered from the modular toy vehicle base, or may be connected to an independent external power supply, or comprise an autonomous power supply like a battery or any suitable energy harvesting device.

As mentioned above, the modular toy vehicle base advantageously comprises one or more motors, a vehicle base controller coupled to the one or more motors, and a communication device coupled to the vehicle base controller. Advantageously, the modular toy vehicle base may further comprise an autonomous power supply, typically also including a battery, such as a rechargeable battery.

The remote control device comprises means for generating control instructions on the basis of and/or in response to user input, and transmit these control instructions to the modular toy vehicle base. The control instructions are for controlling any motorized functions, or actuators associated with the modular toy vehicle base. The control instructions may be generated in a control instructions process implemented in a processor of the toy construction system. Advantageously, the control instructions process is implemented in a processor arranged in the remote control device. The user input is received via user input controls, which may be integrated with a user interface of a computer game defining a virtual game environment associated with the toy vehicle model. The control instructions process may generate control instructions for the operation of the toy vehicle model based on the definition of the virtual game environment and based on user input received from the user control interface. The remote control may comprise a display for presenting a state of the toy vehicle model, an associated virtual game environment, a gaming interface for a computer game, virtual user input controls for receiving user input, optionally supported by auxiliary devices, such as overlays or pointing devices, aiding a user in providing the user input in a precise and user-friendly manner. The remote control device may further comprise actuators of any of the above-mentioned types, for providing user-perceivable output. Preferably, the user-perceivable output is operation specific, such as responsive to specified user-input for controlling the operation of the toy vehicle model. The remote control device may further comprise an autonomous power supply, typically including a battery. A communication interface of the remote control device is adapted to communicate with the communication device of the modular toy vehicle base, e.g. for transmitting control instructions generated by the processor to the modular toy vehicle base, and/or for receiving data from the modular toy vehicle base.

Further according to some embodiments of the toy construction system, the interaction sensor is an accelerometer. According to a preferred embodiment, the interaction sensor is an accelerometer. The accelerometer is typically attached in a fixed orientation with respect to the vehicle base. Most preferably, the accelerometer is adapted to measure acceleration for motion in at least two, preferably three degrees of freedom. Thereby, it is possible to distinguish different interactions by their inherent direction.

According to some embodiments, the three degrees of freedom are three orthogonal degrees of linear motion defining a Cartesian coordinate system, typically denoted as "X", "Y", and "Z". This is particularly useful e.g. in a toy construction system comprising modular toy elements defining a three-dimensional grid for the interconnection of these modular toy elements, most preferably a three-dimensional rectilinear grid. Advantageously, the X, Y, and Z directions of the accelerometer are aligned with the directions of such a three-dimensional rectilinear grid. In such a toy construction system, a building interaction may inherently be associated with the fundamental directions of the three-dimensional rectilinear grid. A directional criterion for the analysis of the interaction signal for determining the occurrence of a building interaction may thus be formulated more easily.

For example, bricks comprising coupling members of the stud-and-cavity type may define a three-dimensional rectilinear grid, wherein e.g. a connection of two bricks coupled together by coupling members of the stud and cavity type may be aligned with the Z-direction of a Cartesian coordinate system defined by the accelerometer signal's vector components. Adding one brick on top of the other, or removing one brick from the top of the other brick, may thus inherently be associated with the Z-direction, and an occurrence of such a building interaction may be determined using a pre-determined criterion of a particularly pronounced acceleration in the Z-direction as compared to the two remaining directions X and Y. According to another example, a wheel change building interaction may be detectable from a pronounced acceleration signal in one particular direction, say X-direction, associated with the direction of pulling a wheel off a friction engagement with an axle oriented in the X-direction, as compared to any of the other directions, Y and Z. In addition to the directional criterion, a criterion comprising a threshold value and/or an upper limit for the acceleration may also be formulated beforehand so as to improve reliability of the detection of the building interaction according to the predetermined criteria.

Alternatively or in addition to the accelerometer other sensor elements using different measurement principles are conceivable for detecting a user's mechanical interaction with the toy vehicle model, and determining the occurrence of a building interaction: e.g. a tilt sensor, a force sensitive resistor, a touch sensor, and/or any combination thereof, wherein the detection of a specific interaction, in particular a building interaction is based on a corresponding analysis of the sensor signal, according to pre-determined criteria.

Further according to some embodiments of the toy construction system, the interaction signal comprises at least two distinct values, preferably at least three distinct values. Different values may represent different directions in space, preferably orthogonal directions (as discussed above), and/or different points in time; preferably as a time series of values. According to some embodiments, a plurality of time series of values is acquired, wherein each time series is for a respective direction in space, with respect to modular toy vehicle base. An interaction signal value may be obtained as an interaction sensor reading. By reading and/or recording multiple distinct values of the interaction signal, e.g. values read for multiple spatial coordinates and/or over a period of time, a signal pattern may be formed from the plurality of interaction sensor readings. The interaction sensor values of a given signal pattern thus have a pre-determined relation with respect to each other with respect to space and/or time. The observed signal pattern may be analysed according to predetermined criteria in order to determine e.g. the occurrence of a building interaction. For example, the signal pattern may be matched against a previously recorded signal pattern or set of signal patterns, which has been determined to exhibit characteristics indicating the occurrence of a building interaction.

Furthermore, a signal analysis of a signal pattern observed in the interaction sensor of a toy vehicle model, such as a time series of interaction signal readings may allow for distinguishing between different types of interactions, so as to distinguish between building interactions and other mechanical interactions with the toy vehicle model, e.g. a gesture type interaction, where the user applies a certain type of predefined mechanical interaction to the toy vehicle model to indicate a certain input, or an event indicating a mechanical interaction of the toy vehicle model with its environment, such as an accident where the vehicle bumps into a hindrance or flips over, or a signal pattern indicating a particular driving manoeuvre being performed, such as a jump over a ramp or the completion of a looping. A signal analysis of a signal pattern observed in the interaction sensor of a toy vehicle model may further allow for distinguishing between different kinds of building interactions, so as to distinguish between e.g. a wheel-change and a rebuilding of the body of the vehicle.

Further according to some embodiments of the toy construction system, the interaction sensor is adapted to generate an interaction signal comprising one or more components, each component being associated with a different spatial direction, and/or wherein the interaction sensor is adapted to generate an interaction signal comprising a time-sequence of values.

By using an interaction sensor that is sensitive to the directional properties of the mechanical interaction, the signal may be analysed as to its directional properties. The analysis of the interaction signal may thus be performed with regard to predetermined characteristics in a directional pattern in the interaction signal.

By using an interaction sensor that can generate a signal comprising temporal information about the mechanical interaction, the signal may be analysed as to its temporal properties. Alternatively or in addition thereto, a time series may also be generated in the processor by accumulating a plurality of interaction sensor readings at a series of different points in time, e.g. using a processor clock to time-stamp subsequent readings. The analysis of the interaction signal may thus be performed with regard to pre-determined characteristics in a temporal pattern in the interaction signal. Furthermore, the analysis of the directional properties of the interaction signal may be combined with an analysis of a time dependence of the interaction signal to improve the granularity and precision in the identification of different kinds of mechanical interactions and/or different types of building interactions.

The time dependence and/or directional pattern may be associated with a specific type of building interaction. An output indicative of a status for this specific building interaction may thus be produced, e.g. a status indicating whether or not the specific building interaction has been recognized in the observed interaction signal.

Advantageously, the signal analysis process is configured to use the directional properties of the interaction signal for recognizing a specific building interaction based on a comparison to pre-determined directional characteristics for the specific building interaction. For example, an accelerometer may provide an interaction signal with vector components X, Y, Z. A prevalence of certain vector components over others may be determined beforehand as a characteristic for a particular type of building interaction. The specific building interaction may then be recognized as being of this particular type, when the signal analysis yields that the corresponding observed interaction signal exhibits the same characteristic prevalence of vector components as determined beforehand. The reliability and precision of recognizing the specific building interaction may further be enhanced by recording a time series of at least a relevant one of the vector components and recognizing a characteristic temporal behaviour of the relevant interaction signal vector component as being attributable to the particular type of building interaction as determined beforehand. For example, disconnecting a snap-fit engagement for a wheel attachment in the direction of the wheel axle may be identified from a pronounced pulse in the accelerometer, notably in the vector component parallel to the wheel axle.

More generally, the interaction signal may comprise a plurality of interaction signal values. The plurality of interaction signal values may be seen as an interaction signal pattern. Advantageously, the interaction signal pattern comprises spatial information about the mechanical interaction. Preferably, the spatial information comprises directional information. Further advantageously, the interaction signal pattern comprises temporal information about the mechanical interaction. Preferably, the temporal information comprises one or more time series of interaction signal values. Further preferably, the interaction signal pattern comprises both spatial and temporal information about the mechanical interaction.

The signal analysis process may thus be configured for recognizing in an interaction signal pattern received from the interaction sensor a pre-determined signal pattern associated with a building interaction, and attributing the recognized signal pattern to the building interaction. The building interaction may be recognized as a specific building interaction among a plurality of different building interactions. If a signal pattern is recognized as a mechanical interaction, but is not attributable to a building interaction, the recognized signal pattern may be discarded as not representing a building interaction and/or attributed to a non-building mechanical interaction. A corresponding building interaction status and/or non-building interaction status of the toy vehicle model may then be set and an output indicative of this status may be provided.

Different pattern recognition techniques may be employed. For example, advantageously, a neural network algorithm may be trained to recognize an interaction, in particular a building interaction, using machine learning. Training data for use in such a machine learning algorithm may e.g. be acquired by repetitively performing the specific interaction in a training routine, and each time record the associated interaction signal pattern. In pattern recognition operation, the trained neural network may then recognize the interaction, in particular a building interaction, from the signal pattern of the interaction signal when the specific interaction is performed. Such a pattern recognition algorithm may advantageously be implemented in the RC processor and/or in the vehicle base controller.

Further according to some embodiments of the toy construction system, the analysis of the interaction signal includes identifying a building interaction among a plurality of predetermined interactions. Different kinds of mechanical interaction cause the interaction sensor to generate different interaction signals or signal patterns, each having corresponding characteristics that can be determined beforehand. Using these characteristics, the signal analysis process may be configured to recognize an observed mechanical interaction as a known kind of mechanical interaction amongst those determined beforehand. For example, one or more criteria may be formulated based on the pre-determined characteristics of the interaction signal for a given kind of mechanical interaction. The criteria may be implemented as programmed instructions in the signal analysis process in order to discriminate whether or not an observed interaction signal can be identified as a known mechanical interaction.

The distinction of different kinds of mechanical interactions may be performed by analysing the interaction signal according to criteria based on pre-determined characteristics in respective observations of the interaction signal for the different kinds of mechanical interaction. The signal analysing process may thus be configured with regard to these criteria, e.g. by configuring programmed instructions in the signal analysis process to develop corresponding values from the interaction signal that are useful for matching the observed interaction signal against the pre-determined characteristics of the different kinds of mechanical interaction, or by any other recognition algorithm implemented on the basis of the pre-determined characteristics.

By configuring the signal analysis process to recognize a plurality of different mechanical interactions, and further to identify a building interaction among those mechanical interactions that can be recognized by the signal analysis process, a more reliable detection of an actual building interaction may be achieved. Building interactions may thus be distinguished from a pre-determined plurality of mechanical interactions, which do not involve a building interaction. The non-building interactions may nevertheless be registered by the interaction sensor, the corresponding mechanical interaction may be identified, and a corresponding non-building interaction status indicative of a non-building mechanical interaction with the toy vehicle model may be developed. The non-building interaction status may be developed alternatively or in addition to the building interaction status. Typical non-building mechanical interactions in the operation of a toy vehicle model may include incidental mechanical interactions, such as resulting from an accident, a crash, a flip-over, a jump, passage over a bumpy surface, a sharp turn, a wheel spin, or the like. According to some embodiments non-building mechanical interactions in the operation of a toy vehicle model may further include non-building mechanical interactions following a pre-defined pattern, such as a particular sequence of shaking, knocking, or tapping. Such a non-building mechanical interaction following a pre-defined pattern is useful, e.g. to encode user gesture input applied directly to the toy vehicle model. Thereby, a simple system with a highly flexible and versatile mechanism is provided that allows for the detection of and discrimination between different kinds of mechanical interactions with the toy vehicle model using the same interaction sensor.

Further according to some embodiments of the toy construction system, the analysis of the interaction signal includes identifying a specific type of building interaction. Analogue to identifying a building interaction among other kinds of interactions, a specific type of building interaction may be identified according to criteria based on pre-determined characteristics in respective observations of the interaction signal for the different types of building interaction. Typically, the specific type of building interaction is identified among a plurality of different types of identifiable building interactions, each having respective pre-determined characteristics. This allows for identifying specific building activities that a user performs on the toy vehicle model based on an analysis of the interaction signal and applying predetermined criteria. For example, the processor may thus distinguish between adding and removing one or more modular toy elements, or between building activities using different coupling techniques, such as one or more coupling techniques selected from the group of a friction engagement, e.g. of the stud-and-cavity type, a snap-fit engagement, a particular type of wheel attachment, or the like. Thereby, a simple system with a highly flexible and versatile mechanism is provided that allows for the detection of and discrimination between different types of building interactions with the toy vehicle model using the same interaction sensor. An enhanced specificity in the detection of the building interaction also allows for an enhanced specificity of the building interaction status output.

Further according to some embodiments of the toy construction system, the analysis of the interaction signal includes identifying a first type of building interaction, identifying a second type of building interaction, and discriminating between the first and second type of building interaction. This allows for identifying multiple building interactions and to distinguish between them, thereby allowing for a more complex detection of a user's building activity based on an analysis of the same interaction signal, e.g. identifying different steps in a building sequence, e.g. identifying, and distinguishing between, both a removal of a (group of) one or more modular toy elements, and a subsequent addition of (a group of) modular toy elements, which may subsequently be interpreted as e.g. the replacement of a part in the toy vehicle model. For example a wheel change may be detected as a sequence of removing and adding a wheel. A wheel change may further be distinguished from the removal and subsequent addition of different kinds of modular toy elements in the same spatial direction, e.g. by distinguishing between different coupling techniques employed (e.g. snap-fit technique; friction engagement technique). The distinction may be made by respective different characteristic traits as observed in the interaction signal for each of these coupling techniques.

Further according to some embodiments of the toy construction system, the analysis of the interaction signal for indications of a building interaction according to predetermined criteria is implemented in a neural network algorithm. Thereby a stable and reliable detection may be achieved, which is tolerant to inherent variations in performing a particular building interaction, and consequently tolerant to variations in the characteristic traits in the observed interaction signal.

Further according to some embodiments of the toy construction system, the neural network algorithm is configured to perform the analysis according to pre-determined criteria by means of a machine-learning routine. The neural network algorithm may be trained to recognize the predetermined signal pattern by providing corresponding training data as obtained in a training routine; The corresponding training data may be produced and related to the specific type of building interaction, e.g. by repetitively performing the relevant type of building interactions and recording a signal pattern of an interaction signal associated therewith.

Further according to some embodiments of the toy construction system, the output indicative of a building interaction status of the toy vehicle model comprises one or more status parameters indicating one or more of the occurrence of a building interaction, an addition of a modular toy element, a removal of a modular toy element, an addition of a composite group of modular toy elements, a removal of a composite group of modular toy elements, an addition of a wheel, a removal of a wheel, and a coupling type involved in a detected building interaction.

Further according to some embodiments of the toy construction system, the output indicative of a building interaction status is transmitted to the remote control device.

By providing an indication of the building interaction status at the remote control device, a control instruction process may generate and/or modify the generation of control instructions in response to a building interaction status, or a change in the building interaction status. The output indicative of a building interaction status may also be used to influence the course of a computer game, or may be used as a reply to a prompt generated in the computer game requesting a building interaction to be performed.

Further according to some embodiments of the toy construction system, the processor further comprises a computer game process defining a virtual game environment associated with the toy vehicle model, wherein the output indicative of a building interaction status is fed as an input to the computer game process, and wherein the computer game process is adapted to modify a definition of said virtual game environment in response to a change in the building interaction status. Information on change in the building interaction status may thus be used for modifying a definition of the virtual game environment, for example triggering a game event, generate or modify a parameter value used in a control instruction for operating the toy vehicle model.

Advantageously according to some embodiments a detection of a building interaction at the toy vehicle model triggers a game event in the associated virtual game environment. Further advantageously according to some embodiments the virtual game environment may prompt for a building interaction, and continuation of the game and/or the attribution of awards, rewards, bonus-points, skills, etc. may be made conditional on completion of the requested building interaction. For example, a virtual crash status in the virtual game environment defined by the computer game process may be repaired in response to the detection of a physical building interaction on the toy vehicle model, and/or reset a corresponding virtual crash status parameter. The detection of a building interaction in the physical world, on the physical toy vehicle model, may thus influence the generation of control instructions in the control instructions process and/or affect the course of a virtual game.

Further according to some embodiments of the toy construction system, the signal analysis process is at least partly implemented in a first processor arranged in the modular vehicle base and/or wherein the signal analysis process is at least partly implemented in a second processor arranged in the remote control device.

Implementing at least a part of the signal analysis process in a processor arranged in the toy vehicle model may be useful for modifying the toy vehicle model control locally in response to building interactions. For example a building interaction mimicking repair by replacing body parts of the toy vehicle model may locally reactivate the motor functions, which may have been deactivated as the result of a detected crash event. Performing the signal analysis locally in the modular toy vehicle base requires a processor, or at least a more powerful processor, but reduces footprint (and thus need for bandwidth) in the communication between the modular toy vehicle base and the remote control device. Furthermore changes mainly affecting the toy vehicle model locally can be performed with a faster response time.

Implementing at least a part of the signal analysis process in a processor arranged in the remote control device may be useful for modifying remote aspects associated with the toy vehicle model control, in response to building interactions. For example, a virtual game environment in the remote control device may be modified, or the control instruction generation in a control instructions process in the remote control device may be modified, in response to a building interaction status output generated by the signal analysis process. Implementation of the signal analysis in the remote control device is thus less demanding on a processor in the modular toy vehicle base, and easier to integrate with a virtual game environment typically implemented in the remote control device.

Combination of both implementations allows distributing different recognition tasks according to where the output is most useful, so as to e.g. optimize for a fast response, minimize the required bandwidth for communication between the modular toy vehicle base and the remote control device, and/or reduce equipment complexity and cost.

Further according to some embodiments of the toy construction system, the remote control device comprises one of a smart phone, a tablet computer, a personal computer, a game controller, and a remote control device with one or more manual controls.

Further according to some embodiments of the toy construction system, the toy construction system further comprises one or more contactless tags carrying tag data associated with a toy vehicle model and/or a virtual game environment associated with the toy vehicle model, and wherein the modular toy vehicle base comprises a tag reader, the tag reader being adapted for contactless reading of the tag data. Advantageously, the tag data is then provided, as applicable, to one or more of the signal analysis process, the control instructions process, and the computer game process.

The tags may be shaped, dimensioned, and configured such that a toy vehicle model with a modular toy vehicle base comprising a tag reader may pass closely by or over the tag while reading the information carried by the tag data. Advantageously according to some embodiments, a contactless tag may be formed as a modular toy tag, wherein the modular toy tag comprises a modular tag housing with coupling members for detachably connecting the modular tag with further modular toy elements of the toy construction system, and in particular with the modular toy vehicle base. The tags may be freely placeable on a play surface and/or may be attachable to the modular toy vehicle. A remote controlled toy vehicle model including the modular toy vehicle base may comprise a tag reader adapted for reading information from the tags in a contactless manner, and in response to reading a tag modify the play experience, e.g. by modifying a configuration of the virtual game environment.

By providing the tag data to the respective processes, it may be used for modifying these processes, e.g. by altering parameters and/or programmed instructions defining a response of the toy construction system to a detected mechanical interaction with the toy vehicle model. Modification may comprise one or more of configuring control instructions from the remote control device to the toy vehicle model, configuring the behaviour of the toy vehicle model in response to control instructions received from the remote control device, and configuring a virtual game environment according to data read from the tag. Configuring the virtual game environment may comprise setting operational parameters and instructions in the virtual game environment. Thereby a close integration of the building interaction detection with the play experience of operating the remote controlled toy vehicle model is achieved, in particular when combining the operation of the physical toy vehicle model with a virtual play experience of an associated computer game. As a consequence, physical play requiring a user to physically interact with the toy vehicle model can be stimulated, even when enhancing the play experience of operating the remote control vehicle with a virtual game environment. Furthermore, the user's physical interaction, in particular a building interaction, can be detected and required by the embodiments of the invention. Consequently a more realistic play experience involving physical modification to the toy vehicle model can be achieved.

According to a yet further aspect, the object of the invention is also achieved by a method of controlling the operation of a toy vehicle model constructed from a toy construction system according to any of the embodiments as disclosed and discussed herein, whereby at least the analogue advantages are achieved. The method includes generating an output indicative of a building interaction status on the basis of an analysis of an observed interaction signal generated by an interaction sensor in a modular toy vehicle base, when operating a toy vehicle model including said modular toy vehicle base.

According to some embodiments, a method of controlling the operation of a toy vehicle model constructed from embodiments of a toy construction system as disclosed herein comprises the method steps of:

initializing a signal analysis process with one or more pre-determined criteria for a building interaction to be detected;

performing a measurement with an interaction sensor, thereby generating an interaction signal;

passing the interaction signal to the signal analysis process;

performing an analysis of the interaction signal for indications of the building interaction according to the pre-determined criteria for the detection of the building interaction to be detected; and generating an output indicative of a building interaction status with respect to the building interaction to be detected.

The output may be used as already discussed elsewhere herein. By way of example, the output indicative of a building interaction to be detected may be useful, in a computer game process associated with the operation of a toy vehicle model as exemplified by the further method steps described in the following.

According to some embodiments a method for controlling the operation of a toy vehicle model in combination with a computer game process associated with the operation of the toy vehicle model, wherein the method comprises further method steps as follows. The computer game may be implemented e.g. on a corresponding remote control device. According to these embodiments, a method of controlling the operation of a toy vehicle model includes steps of:

a) issuing, by the computer game process, a prompt requesting a mechanical interaction, in particular a building interaction to be performed on the toy vehicle model;

b) obtaining a measurement of an interaction signal from an interaction sensor in a modular toy vehicle base of the toy vehicle model;

c) generating an output indicative of a building interaction status based on the obtained interaction signal;

d) determining whether or not a change in a building interaction status has occurred since issuance of the prompt in step a);

e) repeating steps b)-d)

until a first generic time-out criterion is fulfilled, and terminating the prompt of step a) with a negative result;

OR until a change in the building interaction status is determined, and passing the output of step c) back to the computer game process;

f) determining if the detected interaction according to the output of step c) matches the requested interaction according to the prompt of step a); and g) repeating steps a)-f)

until a second generic time-out criterion is exceeded, and terminating the prompt of step a) with a negative result;

OR until a match is determined, and terminating the prompt of step a) with a positive result.

BRIEF DESCRIPTION OF THE DRAWINGS

Preferred embodiments of the invention will be described in more detail in connection with the appended drawings, which show in FIGS. 1-3 embodiments of prior art modular toy elements.

DETAILED DESCRIPTION

Various aspects and embodiments of a toy construction system for the construction and operation will now be described with reference to modular toy elements in the form of bricks. However, the invention may be applied to other forms of modular toy elements for use in toy construction sets. Also, while toy vehicle models with wheels are shown throughout the drawings, the invention is not limited thereto and may be implemented in models of other types of vehicles, such as those previously mentioned herein.

Figure 1:
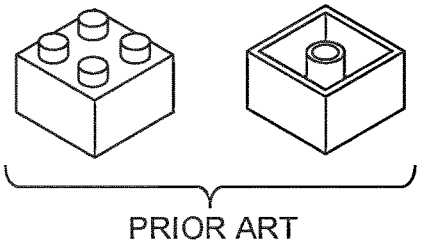
Figure 2:
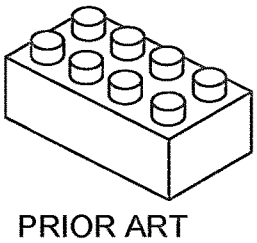
Figure 3:
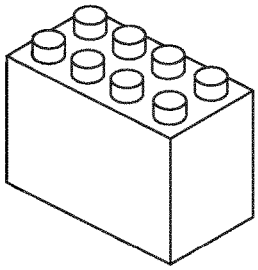

FIG. 1 shows a modular toy element with coupling studs on its top surface and a cavity extending into the brick from the bottom. The cavity has a central tube, and coupling studs on another brick can be received in the cavity in a frictional engagement as disclosed in U.S. Pat. No. 3,005,282. FIGS. 2 and 3 show further prior art modular toy elements. The modular toy elements shown in the remaining figures have this known type of coupling members in the form of cooperating studs and cavities. However, other types of coupling members may also be used in addition to or instead of the studs and cavities. The coupling studs are arranged in a square planar grid, i.e. defining orthogonal directions along which sequences of coupling studs are arranged. The distance between neighbouring coupling studs is uniform and equal in both directions. This or similar arrangements of coupling members at coupling locations defining a regular planar grid allow the modular toy elements to be interconnected in a discrete number of positions and orientations relative to each other, in particular at right angles with respect to each other. The modular toy elements shown here, in FIGS. 1-3, are of the passive type, without additional functionality beyond mechanical model building, such as electromagnetic, electronic, optical, or the like. However, functional modular toy elements may also be combined with embodiments of the present invention. Such functional modular toy elements may in addition to coupling elements for implementing a mechanical model building functionality further include sensors and/or actuators for implementing additional functionality, such as for electromagnetic, electronic and/or optical functions.

Referring to FIGS. 4-10 in the following, an embodiment of a toy construction system for constructing and operating one or more toy car models 10, 10*a*, 10*b* is discussed. The toy construction system supports free building of different toy car models and then operating the toy car models accordingly, as desired by the user of the toy construction system.

Figure 4:
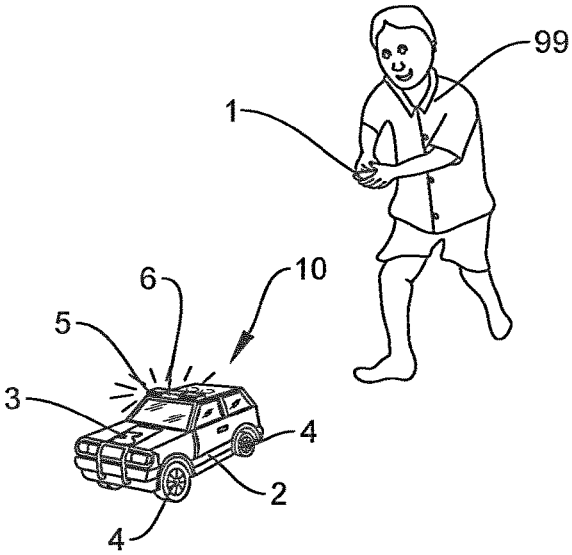
FIG. 4 a toy construction system according to one embodiment, in a first play scenario.

FIG. 4 shows a toy construction system according to one embodiment, in a first play scenario. The toy construction system comprises a handheld remote control device 1 communicatively coupled to a toy vehicle model 10 through a wireless link. Using controls provided on a user interface of the remote control device 1 a user 99 can operate the toy vehicle model by remotely controlling functions thereof. The toy vehicle model comprises a modular toy vehicle base 2 and modular toy elements 3, 4, 5, 6 detachably connected to the modular toy vehicle base 2. In the embodiment shown here, the toy vehicle model 10 is a car with a body formed of passive modular toy elements 3, detachable wheels 4, a rooftop light-bar made of functional modular toy elements 5 adapted to provide user-perceivable output, such as flashing lights and/or siren sounds, and a tag modular toy element 6 comprising tag data for configuring the toy vehicle model for a specific play context (here for configuring functions of the toy vehicle model as a police car).

Figure 5:
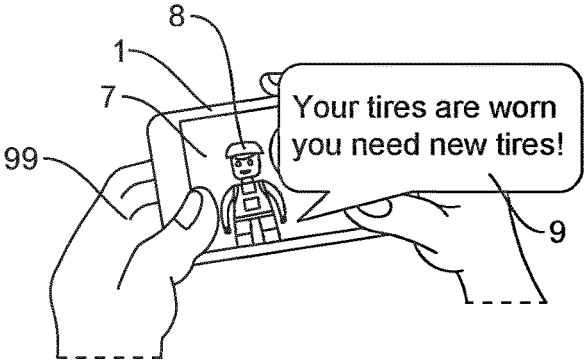
FIG. 5 a remote control device of the toy construction system according to the embodiment of FIG. 4, in a second play scenario.
Figure 7:
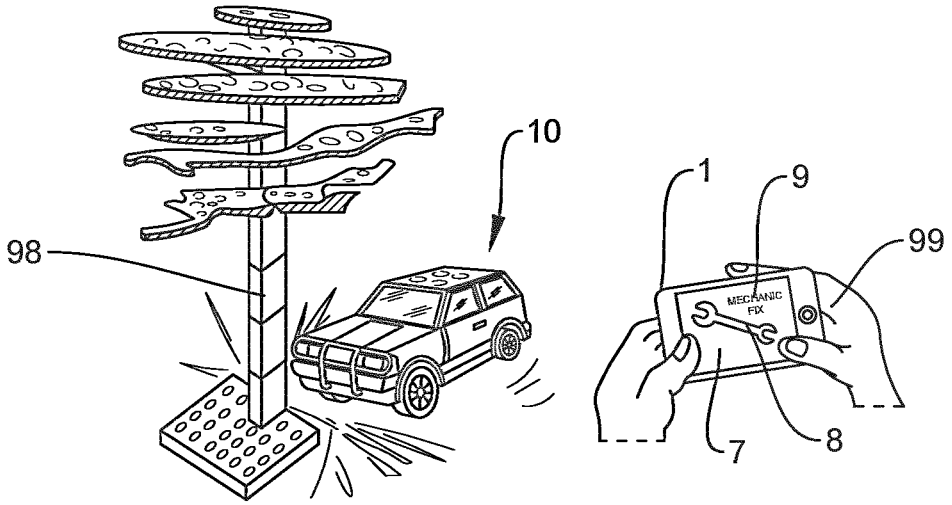
FIG. 7 the toy construction system according to the embodiment of FIG. 4, in a fourth play scenario.

As shown in FIGS. 5 and 7, the handheld remote control device 1 may be a smart device, such as a smart phone, a tablet computer, or a handheld gaming device with a video display adapted to provide a graphical representation to the user 99 of a virtual game environment 8. The virtual game environment 8 is defined by a computer game process, which may be implemented in the handheld remote control device 1. In the course of the game, the user 99 may be requested in a prompt 9 to perform a building interaction on the toy vehicle model 10. The request may e.g. be a result of a virtual simulation of degradation in performance, in response to continued use of the toy vehicle model 10. Here, the prompt 9 tells the user that the tires of his car are worn and new tires are required. The user 99 is thus requested to perform a wheel change building interaction, e.g. in order to pass a virtual inspection in the virtual game environment 8, and/or in order to regain full performance in speed or steering precision in the operation of the toy vehicle model 10 in the physical world.

Figure 6:
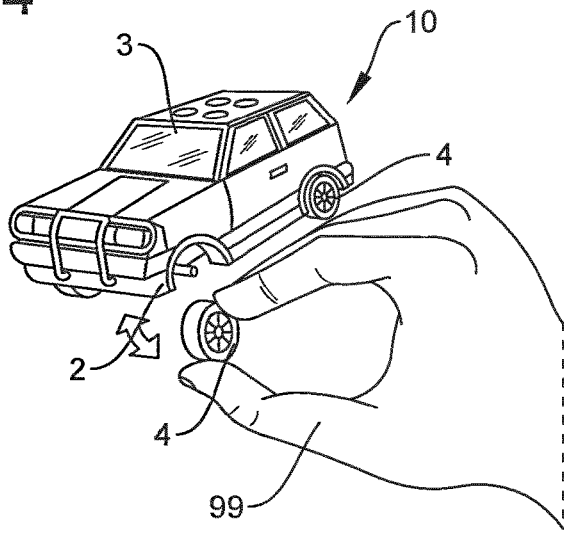
FIG. 6 a toy vehicle model constructed from the toy construction system according to the embodiment of FIG. 4, in a third play scenario associated with the second play scenario.

The user 99 may then proceed to physically change the wheels 4 of the toy vehicle model 10, as shown in FIG. 6. The wheel change is sensed by an interaction sensor 21 in the modular toy vehicle base 2, a corresponding interaction signal from the interaction sensor is then analyzed in a signal analysis process 11 to be identified as a specific building interaction, and a building interaction status indicative of the occurrence of a wheel change building interaction is generated. The building interaction status may be fed back as an input to the computer game process 13, which may then trigger a game event in the virtual game environment 8. For example, following the above-mentioned prompt 9 requesting a wheel change, the computer game process 13 may upon receipt of a building interaction status indicative of a wheel change allow the user to continue, award an "inspection passed", reset a simulated degradation in performance of the car, and cause a restitution of the speed and/or steering performance of the remote controlled toy vehicle model 10 in response to a user's control input through a control instructions process 12.

In another play scenario as shown in FIG. 7, the remote control device 1 may on display 7 showing a virtual game environment 8 present a prompt 9 to user 99 requesting a mechanical fix of the body of the toy vehicle model 10 in response to a crash of the toy vehicle model 10 into an obstacle 98 in the physical environment. The crash may also be detected by the interaction sensor 21 and e.g. analyzed in the signal analysis process 11 to be classified more generally as a "violent non-building interaction", or more specifically as a "crash", or even as a "front impact crash", and a corresponding interaction status may be sent to the computer game process 13. Computer game process 13 may disable the toy vehicle model, e.g. by disabling the generation of control instructions in response to a user's control input in a control instructions process 12. The computer game process 13 may then prompt the user 99 for body works to be performed on the toy vehicle model before the game can continue and the toy vehicle model 10 can again be operated. The body works may be detected by monitoring the interaction signal from the interaction sensor 21, and by analyzing the interaction signal in the signal analysis process as building interactions of removal and/or addition of modular toy elements 3 as identified in characteristic directional and/or temporal traits in the interaction signal for disengaging and or engaging coupling members 23. Upon detection of such a building interaction involving coupling members 23 the corresponding building interaction status may be updated, and the operability of the toy vehicle model 10 may be restituted.

Figure 8:
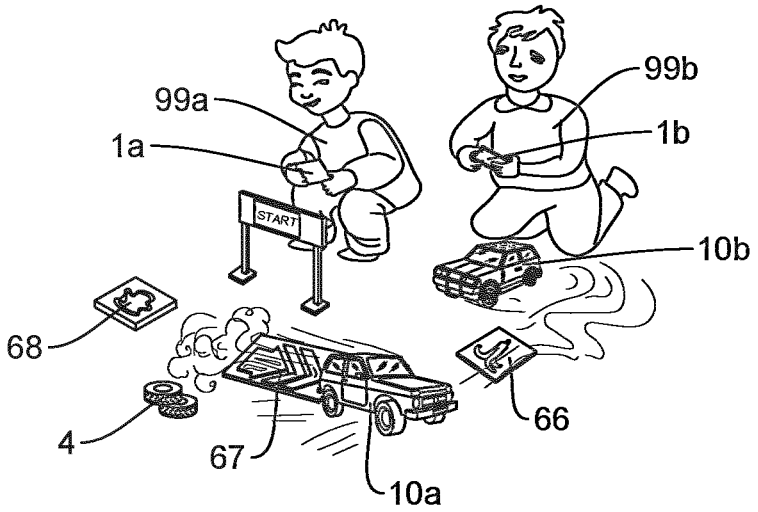
FIGS. 8, 9 toy construction systems according to the embodiment of FIG. 4, in further play scenarios.
Figure 9:
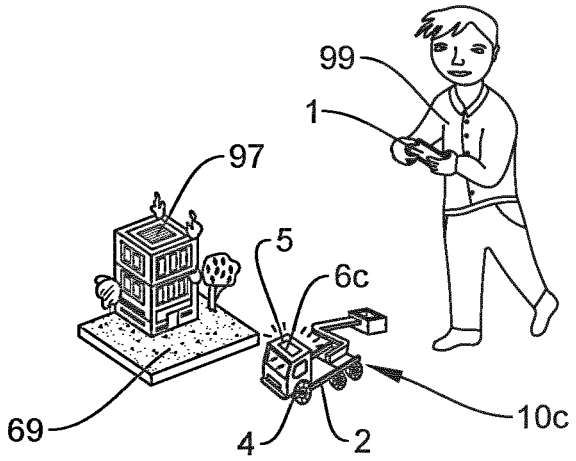

Further play scenarios of using an embodiment of the toy construction system are shown in FIGS. 8 and 9. FIG. 8 shows two users 99*a*, 99*b* using handheld remote control devices 1*a*, 1*b* to operate toy racing car models 10*a* and 10*b*, which they have built from the toy construction system. Advantageously, the toy vehicle models 10*a*, 10*b* may be tagged as racing cars by including tag modular toy elements 6 carrying tag data associated with a car racing environment. Tag readers arranged in the modular toy vehicle bases of the cars 10*a*, 10*b* may read the tag data and configure the modular toy vehicle bases and/or the remote control devices 1*a*, 1*b* accordingly. Further tags 66, 67, 68 may be placed freely on a play surface and may also be read by tag readers in the toy vehicles 10*a*, 10*b*. Preferably, the respective tag readers are configured and arranged to be useful both for reading tag modular toy elements 6 included in a toy vehicle model 10*a*, 10*b* and for reading surface tags 66, 67, 68 when these are passed over by, or detected in the immediate vicinity of, a toy vehicle model 10*a*, 10*b*. The surface tags may carry surface tag data for defining a general play context, such as a racing environment, for defining a specific play context, such as defining specific events or missions in a game, or for defining a toy vehicle control response, such as for providing a turbo performance with enhanced speed or for mimicking aquaplaning through a loss of steering control. Reading tag data when passing by or over such surface tags may also be used to trigger a request for mechanical interaction with the toy vehicle models 10*a*, 10*b* in a computer game process which may then be dealt with in manner analogue to what has been discussed above. For example, a fire truck 10*c*, which has been built from a modular toy vehicle base 2 using modular toy elements 3, 4, 5, and which may even have been tagged as such by a corresponding tag modular toy element 6*c*, is controlled by a user 99 from a handheld remote control device 1 to pass by a model of a building 97 including a surface tag 69 identifying the building as a fire site. A tag reader 26 in the modular toy vehicle base 2, which has been set to a fire truck configuration by means of the tag modular toy element 6, may read the fire site surface tag 69 upon arrival and, in response to reading said surface tag saying "address of fire site" and request the user to stop the vehicle and perform a physical interaction with the fire truck model while in the vicinity of the surface tag 69. The mechanical interactions may be detected from interaction signal patterns characteristic for playful interactions, such as operating a ladder, opening hatches, and in particular from interaction signal patterns characteristic for building interactions, such as detaching and/or attaching modular toy elements (that may represent firefighting equipment or firefighters).

Figure 10:
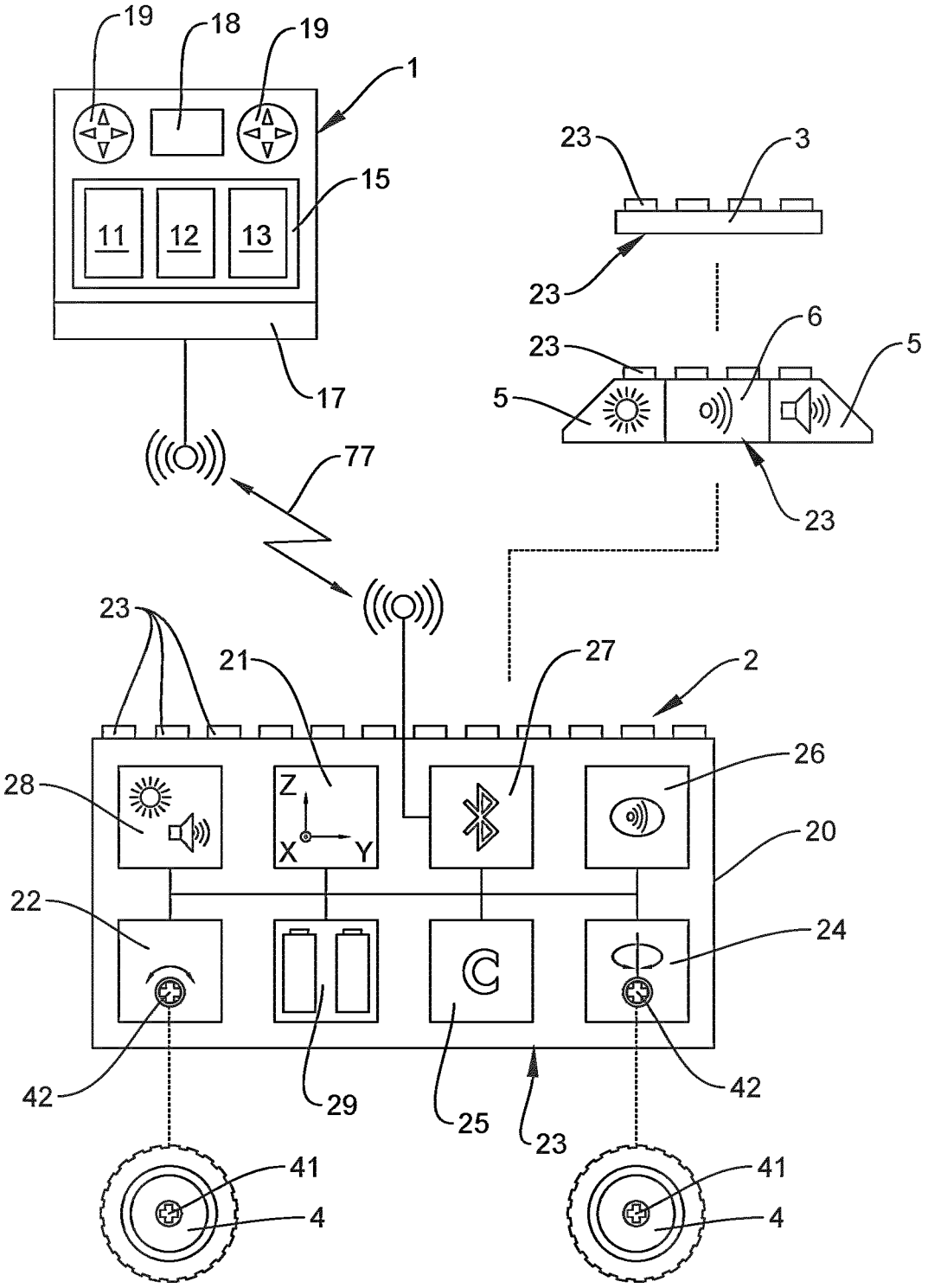
FIG. 10 a schematic overview over the toy construction system according to the embodiment of FIG. 4.

As seen in FIG. 10, the toy construction system comprises a remote control device 1, a modular toy vehicle base 2, and modular toy elements 3, 4, 5, 6. The modular toy vehicle base 2 has a housing 20 with coupling elements 23 for detachably connecting the modular toy elements 3, 5, 6 thereto. Arranged within the vehicle base housing, the modular toy vehicle base 2 comprises a propulsion motor 22 and a steering servo 24. The wheels 4 have hub coupling members 41 for detachably mounting the wheels 4 to axles 42 on the motors 22, 24. The motors 22, 24 are controlled by a vehicle base controller 25 in response to control instructions received through a communication device 27. For example, the communication device 27 may be compliant with any known digital communication standard suitable for the remote control of toy vehicle models, such as Bluetooth compliant or similar. If applicable, the control instructions may be modified and/or interpreted according to a context defined by tag data that are obtained by means of a wireless near field tag reader 26, such as according to any suitable near field communication ("NFC") standard or radio frequency identification (RFID) standard. The modular toy vehicle base 2 as shown here may further comprise one or more actuators 28 for generating user-perceivable output, such as light and/or sound, in response to commands received from the vehicle base controller 25. All or at least some of the components 21, 22, 24, 25, 26, 27, 28 of the modular toy vehicle base 2 may be powered by an autonomous power supply 29, typically comprising an energy storage device, e.g. batteries, and in particular rechargeable batteries.

The modular toy vehicle base 2 further comprises an interaction sensor 21 for detecting mechanical interactions with a toy vehicle model 10 including the modular toy vehicle base 2. Preferably, the interactions sensor 21 comprises an accelerometer. Most preferably the accelerometer is sensitive to mechanical interaction in all spatial directions. The interaction sensor 21 is thus capable of sensing mechanical interactions in three Cartesian coordinate directions X, Y, Z, which are aligned with spatial directions that are characteristic for building interactions with the toy vehicle model as determined by the coupling elements 23 and 41/42 of the toy construction system. When the interaction sensor 21 senses a mechanical interaction, it generates a corresponding interaction signal representative of the sensed mechanical interaction.

The interaction signal is passed to a signal analysis process 11. The signal analysis process 11 performs an analysis of the interaction signal for indications of a building interaction according to pre-determined criteria, and generates an output indicative of a building interaction status based on the analysis. The output indicative of a building interaction status may be passed on for use in a control instruction process 12 adapted to use said indications of a building interaction when generating control instructions for controlling the toy vehicle model 10. The output indicative of a building interaction status may further be passed on for use in a computer game process 13 adapted to use said indications of a building interaction to dynamically define a virtual game environment 8 in response to the detection of building interactions, e.g. as discussed above.

The toy construction system further comprises modular toy elements 3, 4, 5, 6 that may be detachably connected with the modular toy vehicle base 2 through respective coupling elements 23, 41/42, so as to build a desired toy vehicle model 10. The modular toy elements 3, 4, 5, 6 may include passive modular toy elements 23, wheels 4, functional toy elements 5 for producing user-perceivable output, and tag modular toy elements 6 for carrying tag data. The tag data may, for example, carry instructions for defining a general play context, for defining a specific play context, or for defining a toy vehicle control response.

The remote control device 1 is adapted to control motorized functions in the modular toy vehicle base 2. The remote control device 1 comprises a user control interface for receiving user input. The user control interface may have virtual controls, e.g. implemented on a touch screen as those seen in FIGS. 5 and 7, or may have manual controls 19 as shown here in FIG. 10, or may even have a combination of both. The remote control device 1 further comprises a processor 15. The processor 15 comprises a signal analysis process 11, a control instructions process 12 and a computer game process 13. The signal analysis process 11 is for analyzing the interaction signal from the interaction sensor 21 as discussed elsewhere herein. Alternatively or in addition thereto the same or a complementary signal analysis process may also be implemented in the processor 25 arranged in the modular toy vehicle base 2. The control instructions process 12 is for generating control instructions for the operation of the toy vehicle model based on the definition of the virtual game environment and on user input received from the user control interface, and optionally on the basis of tag data obtained from a tag modular toy element 6 and/or a surface tag 66, 67, 68, 69. The computer game process 13 defines a virtual game environment associated with the toy vehicle model (and optionally on the basis of tag data obtained from a tag modular toy element 6 and/or a surface tag 66, 67, 68, 69). The remote control device 1 further comprises a communication interface 17 coupled to the processor 15. The communication interface 17 is adapted to communicate with the communication device 27 of the modular toy vehicle base 2 through a wireless link 77. The remote control device 1 shown in FIG. 10 optionally further comprises a display 18 for presenting a status in the remote control device 1, in the modular toy vehicle base 2 or an associated toy vehicle model, and/or in a virtual game associated with the operation of said associated toy vehicle model.

Figure 11:
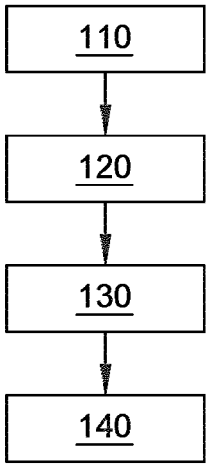
FIG. 11 a diagram with method steps of operating a toy vehicle model according to some embodiments; and in FIG. 12 a diagram with further method steps of operating a toy vehicle model according to some embodiments.
Figure 12:
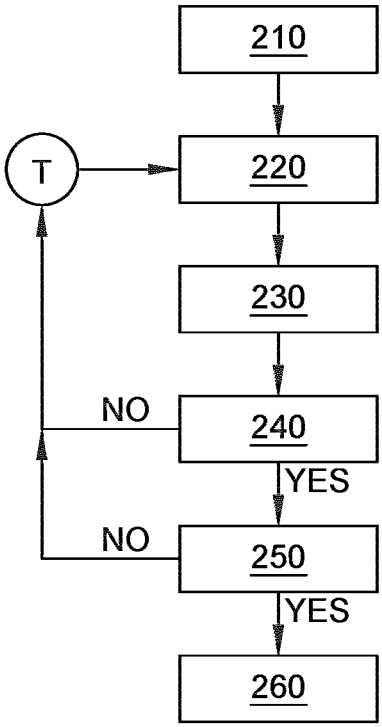

Referring to FIGS. 11 and 12 in the following, examples of method steps of operating a toy vehicle model constructed from embodiments of a toy construction system as disclosed herein are described. FIG. 11 shows a diagram with method steps 110, 120, 130, 140 for generating an output indicative of a building interaction status on the basis of an analysis of an observed interaction signal generated by an interaction sensor in a modular toy vehicle base, when operating a toy vehicle model including said modular toy vehicle base. In step 110, a signal analysis process is initialized according to pre-determined criteria for a building interaction of the type to be detected. In step 120, a measurement is performed with an interaction sensor, thereby generating an interaction signal, which is passed to the signal analysis process. In step 130, an analysis of the interaction signal for indications of the building interaction to be detected is performed. In step 140, an output indicative of a building interaction status with respect to the building interaction to be detected is generated. The output may be used as already discussed elsewhere herein. By way of example, the output indicative of a building interaction to be detected may be useful, in a computer game process associated with the operation of a toy vehicle model as exemplified by the further method steps described in the following with reference to FIG. 12. FIG. 12 shows a diagram with further method steps 210, 220, 230, 240, 250, 260 of operating a toy vehicle model according to some embodiments in combination with a computer game process associated with the operation of the toy vehicle model, and as implemented e.g. on a corresponding remote control device. In step 210, a computer game process may issue a prompt requesting a mechanical interaction, in particular a building interaction to be performed on the toy vehicle model. In step 220 a measurement of an interaction signal is obtained from an interaction sensor in a modular toy vehicle base of the toy vehicle model. In step 230, the obtained interaction signal is analysed and an output indicative of a building interaction is generated. In step 240, a query is performed determining whether or not a change in building interaction status has occurred since the prompt of step 210. In case no change has occurred, steps 220, 230, and 240 are repeated until a time-out "T" is exceeded, in which case the prompt is terminated with a negative result. In case a change is determined, the output of step 230 is passed back to the computer game process. In step 250, a query is performed determining if the detected interaction according to the output of step 230 matches the requested interaction according to the prompt of step 210. In case no match is determined, steps 210, 220, 230, 240, 250 are repeated until a time-out "T" is exceeded, in which case the prompt is terminated with a negative result. If a match is determined, the prompt is terminated with a positive result in step 260.

The invention claimed is:

1. A toy construction system for constructing and operating a remote controlled toy model, the system comprising:

a plurality of modular toy elements;

a modular toy base detachably connectable with the modular toy elements by coupling members so as to construct a toy model;

a remote control device configured to control motorized functions in the modular toy vehicle base;

an interaction sensor configured to generate an interaction signal in response to a mechanical interaction with the toy model; and a processor with a signal analysis process, the signal analysis process being configured to perform an analysis of the interaction signal for indications of a building interaction according to predetermined criteria, and based on the analysis to generate an output indicative of a building interaction status, wherein the building interaction is one or more of an addition or removal of one or more of the plurality of modular toy elements.

2. The toy construction system according to claim 1, wherein the interaction sensor is an accelerometer attached in a fixed orientation with respect to the vehicle base.

3. The toy construction system according to claim 2, wherein:

the accelerometer is adapted to measure acceleration for linear motion in three orthogonal directions;

the modular toy elements are adapted for interconnection according to a three-dimensional rectilinear grid, and the directions of measurement of the accelerometer are aligned with the directions of the three-dimensional rectilinear grid.

4. The toy construction system according to claim 1, wherein:

the interaction signal is sensitive to the directional properties of the mechanical interaction, and the analysis of the interaction signal is performed with regard to pre-determined characteristics in a directional pattern in the interaction signal.

5. The toy construction system according to claim 1, wherein the interaction sensor is configured to generate an interaction signal comprising one or more components, each component being associated with a different spatial direction, and wherein the interaction sensor is configured to generate an interaction signal comprising a time-sequence of values.

6. The toy construction system according to claim 1, wherein the analysis of the interaction signal includes identifying a building interaction among a plurality of predetermined interactions.

7. The toy construction system according to claim 1, wherein the analysis of the interaction signal includes identifying a specific type of building interaction.

8. The toy construction system according to claim 1, wherein the analysis of the interaction signal includes identifying a first type of building interaction, identifying a second type of building interaction, and discriminating between the first and second type of building interaction.

9. The toy construction system according to claim 1, wherein the analysis of the interaction signal for indications of a building interaction according to predetermined criteria is implemented in a neural network algorithm.

10. The toy construction system according to claim 1, wherein:

the interaction sensor is configured to generate a signal comprising temporal information about the mechanical interaction, and the analysis of the interaction signal is performed with regard to pre-determined characteristics in a temporal pattern in the interaction signal.

11. The toy construction system according to claim 1, wherein the output indicative of a building interaction status of the toy model comprises one or more status parameters indicating one or more of:

the occurrence of a building interaction;

an addition of a modular toy element;

a removal of a modular toy element;

an addition of a composite group of modular toy elements;

a removal of a composite group of modular toy elements;

an addition of a wheel;

a removal of a wheel; and a coupling type involved in a detected building interaction.

12. The toy construction system according to claim 1, wherein the output indicative of a building interaction status is transmitted to the remote control device.

13. The toy construction system according to claim 1, wherein:

the processor further comprises a computer game process defining a virtual game environment associated with the toy model, the output indicative of a building interaction status is fed as an input to the computer game process, and the computer game process is configured to modify a definition of said virtual game environment in response to a change in the building interaction status.

14. The toy construction system according to claim 1, wherein:

the signal analysis process is at least partly implemented in a first processor arranged in the modular base, and the signal analysis process is at least partly implemented in a second processor arranged in the remote control device.

15. The toy construction system according to claim 1, wherein the remote control device comprises one of a smart phone, a tablet computer, a personal computer, a game controller, and a remote control device with one or more manual controls.

16. The toy construction system according to claim 1, wherein:

the toy construction system further comprises one or more contactless tags carrying tag data associated with a toy model or a virtual game environment associated with the toy model, and the modular toy base comprises a tag reader configured to contactless read the tag data.

17. The toy construction system according to claim 1, wherein the remote controlled toy model is a remote controlled toy model, and wherein the modular toy base is a modular toy vehicle base.

18. A method for operating a remote controlled toy model, the method comprising the steps of:

generating an interaction signal, with an interaction sensor, in response to a mechanical interaction with the remote controlled toy model;

analyzing the interaction signal, with a processor, for indications of a building interaction according to predetermined criteria;

generating an output indicative of a building interaction status, with the processor, based on the analysis; and transmitting the output indicative of a building interaction status from the processor to a remote control to operate the remote controlled toy model, wherein the building interaction is one or more of an addition or removal of one or more modular toy elements.

19. The method according to claim 18, wherein the output indicative of a building interaction status is provided as an input to a computer game process associated with the operation of the remote controlled toy model.

20. The method according to claim 18, further comprising the steps of:

issuing, by a computer game process associated with the operation of the remote controlled remote controlled toy model, a prompt requesting a building interaction to be performed on the model prior to generating the interaction signal; and determining whether or not a change in a building interaction status has occurred since issuance of the prompt after generating the output indicative of a building interaction status.

21. A toy construction system for operating a remote controlled toy model, the system comprising:

a plurality of modular toy elements;

a modular toy base detachably connectable with the modular toy elements so as to construct a toy model, wherein the modular toy base includes an interaction sensor configured to generate an interaction signal in response to a mechanical interaction with the toy model; and a remote control device having a processor and configured to control motorized functions in the modular toy base, wherein the processor is operative to: analyze the interaction signal for indications of a building interaction according to predetermined criteria; and modify performance of the toy model based on analysis of the interaction signal, wherein the building interaction is one or more of an addition or removal of one or more of the plurality of modular toy elements.

22. A toy construction system for constructing and operating a remote controlled toy model, the system comprising:

a plurality of modular toy elements;

a modular toy base detachably connectable with the modular toy elements by coupling members so as to construct a toy model;

a remote control device configured to control motorized functions in the modular toy base;

an interaction sensor configured to generate an interaction signal in response to a mechanical interaction with the toy model; and a processor with a signal analysis process, the signal analysis process being configured to perform an analysis of the interaction signal for indications of a building interaction according to predetermined criteria, and based on the analysis to generate an output indicative of a building interaction status, wherein:

the toy construction system further comprises one or more contactless tags carrying tag data associated with a toy model or a virtual game environment associated with the toy model, and the modular toy base comprises a tag reader configured to contactless read the tag data.

* * * * *